US005617660A

United States Patent [19]

Pollack

[11] Patent Number: 5,617,660

[45] Date of Patent: Apr. 8, 1997

[54] DISPLAY FRAME WITH SLOT FOR EXCHANGEABLE DISPLAY

[76] Inventor: Ronald M. Pollack, 20 Continental Ave., Forest Hills, N.Y. 11375

[21] Appl. No.: 410,663

[22] Filed: Mar. 27, 1995

[51] Int. Cl.[6] ..... G09F 7/02

[52] U.S. Cl. ..... 40/611; 40/729; 40/761; 40/765; 40/782

[58] Field of Search ..... 40/605, 611, 729, 40/730, 733, 761, 765, 782, 783, 775

[56] References Cited

U.S. PATENT DOCUMENTS

| | | | |
|---|---|---|---|
| 4,348,826 | 9/1982 | Reim | 40/155 |
| 4,477,990 | 10/1984 | Buchanan | 40/155 |
| 4,912,864 | 4/1990 | Price | 40/155 |
| 4,986,013 | 1/1991 | Pollack | 40/611 X |
| 5,398,376 | 3/1995 | Pollack | 16/225 |

*Primary Examiner*—Brian K. Green
*Attorney, Agent, or Firm*—Galgano & Burke

[57] ABSTRACT

A display frame for a poster having a top edge and at least two side edges includes a resilient first edge support for the top edge of said poster, a pair of resilient second edge supports for at least the side edges of said poster, and a plurality of resilient fastening elements associated with said edge supports for fastening said edge supports together in a frame-like manner. A pair of generally L-shaped internal angle fittings are employed for securing the pair of second edge supports to opposite ends of the first edge support. The rear of the first edge support is positioned offset and forwardly of the rear of the second edge supports so as to define therebetween a display slot whereby a poster may be removably slid into said display frame from above, rearwardly of the first edge support with the lateral edges of said poster being slidably received in a slotted channel defined by the second edge supports.

6 Claims, 4 Drawing Sheets

DISPLAY FRAME WITH SLOT FOR EXCHANGEABLE DISPLAY

BACKGROUND OF THE INVENTION

The present invention relates to an improved display frame. More particularly, it relates to such a display frame having internal angle fittings which provide an opening or slot for the quick, facile and simple exchange of the generally planar display, such as a picture, poster or other display item.

In my earlier patents for a picture and a poster frame, e.g., U.S. Pat. Nos. 4,669,209 and 4,986,013, I have described picture, display frames, e.g., poster frames and the like, which are very inexpensive and easy to assemble and which may be used for the practical framing of a wide variety of pictures, posters, commercial signs and other generally planar display boards or the like, for both residential or commercial use.

Especially for commercial purposes, it is often necessary to quickly change the poster or display, and while the aforementioned frames are easily assembled and re-assembled, it would be advantageous for the same to have a slot or the like by which one could easily exchange the display material typically made of card stock or the like to allow for easy updating or changing of the displayed material.

Display frames are known which are provided with a slot along the top frame section thereof to allow for easy insertion and removal of the poster or the like. However, these frames are rather expensive and require the provision of frame components exactly matched to the dimensions of the desired poster frame. They also are not suitable with the snap-on display frames of the type described above.

SUMMARY OF THE INVENTION

Accordingly, it is an object of the present invention to provide a novel display frame with internal angle fittings which allows the display frame to form an open drop-in slot for the easy and quick insertion and removal of the display item into the display frame.

It is a further object of the present invention to provide such a novel display frame for a poster-like display or picture wherein no support elements or structure are utilized with the picture other than the picture frame itself.

It is also an object of the present invention to provide such a display stand having internal angle fittings which can also serve as legs for the display frame and which also eliminate the need for exact cut frame length for the frame sections which are joined together to form the frame.

It is a more particular object of the present invention to provide such a novel display frame which is of relatively simple and inexpensive construction, which affords greater rigidity in the frame structure, and which allows greater versatility of use in connection with the grouping of different pictures and the use of double sided pictures, signs or displays.

Certain of the foregoing and related objects are readily attained in a display frame for a poster or the like having a top edge and at least two side edges comprising a resilient first edge support for the top edge of said poster, said first edge support extending the majority of the length of said top poster edge and including an inverted generally T-shaped back plate, extending the length thereof, having a base leg and an upstanding leg disposed generally normally to said base leg and having a first end interconnected generally centrally of said base leg and a second end, and a generally C-shaped dome member having a center section interconnected with said second end of said upstanding leg of said back plate and two curved legs, each of which extend toward opposite ends of said base leg of said base plate to define, a gap between the ends of said curved legs, and said base leg in cooperation with said base plate and said dome member defining a pair of slotted channels. The frame includes a pair of resilient second edge supports for at least the side edges of said poster, each of said second edge supports extending the majority of the length of a respective poster side edge and including a generally rectilinear base plate extending the length thereof having two opposite sides and ends and a pair of dome members having first and second legs, interconnected to opposite ends of said base plate in a generally opposing, mirror-image fashion, one of said dome members being C-shaped with its first and second legs extending toward the first and second legs of the opposing dome member, to define a gap between the ends thereof, the other of said dome members having a curved first leg extending toward but spaced from said first leg of said one dome member and a second leg spaced from said second leg of said one dome member so as to define a pair of slotted channels, the slotted channel defined between the second legs of said dome members being dimensioned to allow for easy and facile slidable insertion and removal of a side edge of a poster thereinto. A plurality of resilient fastening elements are associated with said edge supports for fastening said edge supports together in a frame-like manner, said fastening elements each having first and second legs and being substantially C-shaped to overlay the C-shaped dome members of said first and second edge supports and engage therewith in a snap fit manner. A pair of generally L-shaped internal angle fittings are provided for securing said pair of said second edge supports to opposite ends of said first edge support, said L-shaped angle fittings each including a first leg configured and dimensioned for frictional receipt within the slotted channel defined by said first legs of said dome members of said second edge supports and a second bifurcated leg having a first arm and a second arm received in opposite channels of said first edge support in a frictional fit manner such that said first edge support is joined to said second edge support with said base leg of said base plate of first edge support positioned offset and forwardly of said second legs of said second edge supports so as to define therebetween a display slot. Thereby, a poster may be removably slid into said display frame from above, rearwardly of said first edge support with the lateral edges of said poster being slidably received in said slotted channel defined by and between said second legs of said other dome members of said second edge supports.

Preferably said first edge support is provided for the top edge of the poster and three second edge supports are provided, two for the side edges of the poster and one for the bottom edge. Most desirably, a fastening element is provided at each end of said edge support. The fastening elements advantageously comprise elbow-shaped corner fastening elements, to engage with adjacent ends of adjacent edge supports. The edge supports are preferably formed of plastic.

Certain of the foregoing and related objects are readily attained in a display frame for a poster or the like having a top edge and at least two side edges comprising a resilient first edge support for the top edge of said poster, said first edge support extending the majority of the length of said top poster edge, a pair of resilient second edge supports for at least the side edges of said poster, each of said second edge supports extending the majority of the length of a respective poster side edge, and a plurality of resilient fastening elements associated with said edge supports for fastening said edge supports together in a frame-like manner, The fastening elements each have first and second legs and are shaped to overlay said first and second edge supports and engage therewith in a snap fit manner. A pair of generally L-shaped internal angle fittings are provided for securing said pair of said second edge supports to opposite ends of said first edge support in a frictional fit manner such that said first edge support is joined to said second edge supports with a rear wall of said first edge support positioned offset and forwardly of a rear wall of said second edge supports so as to define therebetween a display slot. Thereby, a poster may be removably slid into said display frame from above, rearwardly of said first edge support with the lateral edges of said poster being slidably received in a slotted channel defined by and between said second edge supports.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED AND ILLUSTRATED EMBODIMENTS

Figure 1:
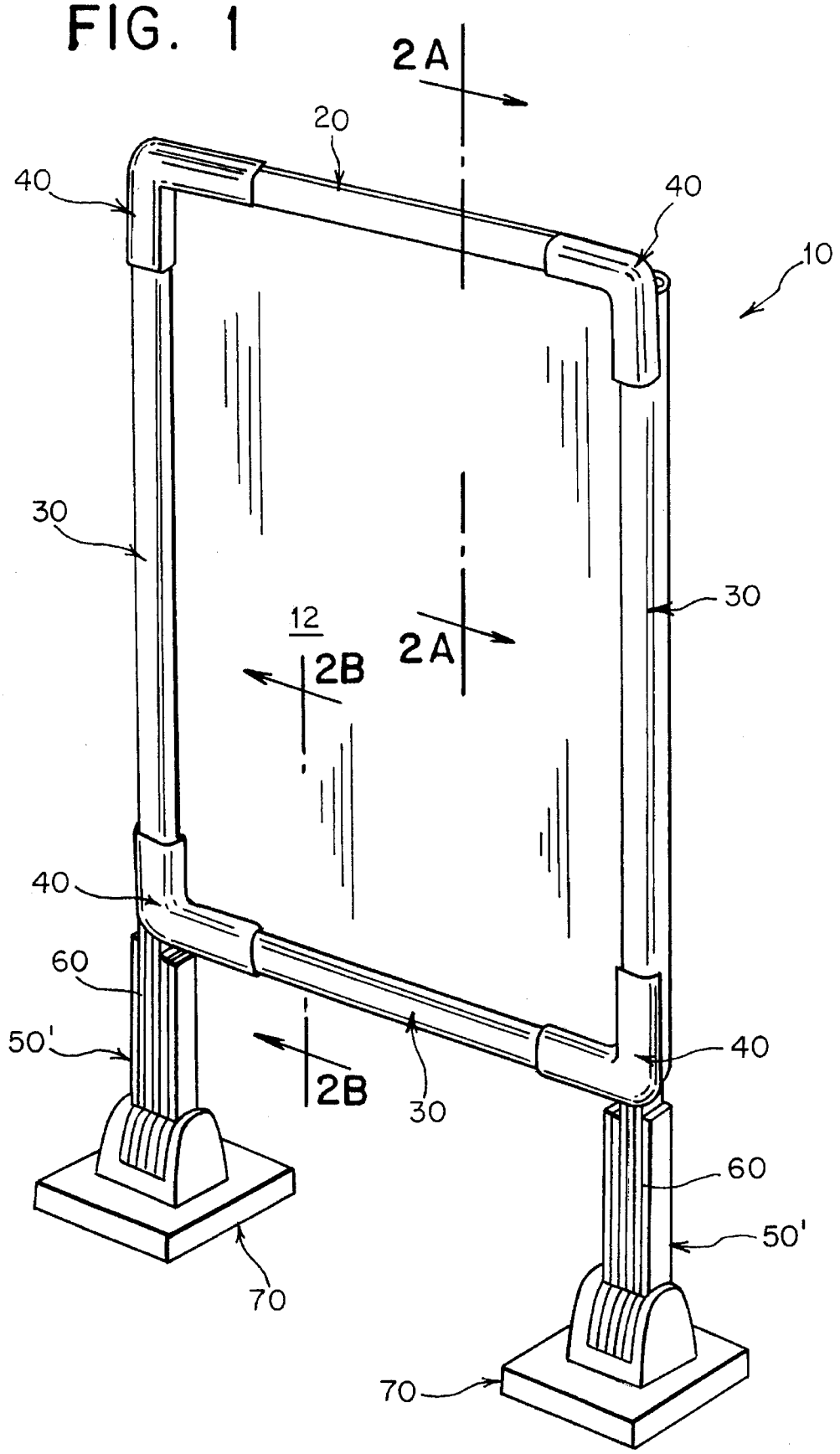
FIG. 1 is a perspective view of a novel display frame embodying the present invention.

Turning now in detail to the drawings, and, in particular FIG. 1 thereof, therein illustrated is a novel display frame with an exchangeable display embodying the present invention generally designated by reference numeral 10. The display stand of the present invention is similar to the picture and poster display frames described in U.S. Pat. Nos. 4,669,209 and 4,986,013, the subject matter of which are incorporated herein by reference thereto.

More particularly, the present invention is intended to frame a poster-like picture 12 or planar display board 12 which is generally formed of relatively stiff paper or paperboard. For the purpose of displaying poster 12 so that it may be hung from a wall or similar structure without distortion or so that it may be displayed upright in a stand or the like, the top edge of the picture 12, as well as the side and bottom edges thereof are provided with edge supports generally designated 20, 30, respectively, to which fastening elements generally designated 40 are engaged for securing the edge supports 20, 30 together. The display frame 10 additionally includes generally L-shaped internal angle fittings 50 which also secure the edge supports 20, 30 together, thereby to provide additional integrity to the frame. Fittings 50 also assist in the provision of an open slot for the easy exchange of the poster material, as described in greater detail hereinafter and the bottom corner internal angle fittings 50 are provided with legs 60 by which the stand 10 may be mounted and supported on slotted frame stand supports 70. The edge supports 20, 30 are preferably made of plastic extrusions and the fastening elements 40 and internal angle fittings 50 are preferably formed of injection-molded plastic.

Figure 3:
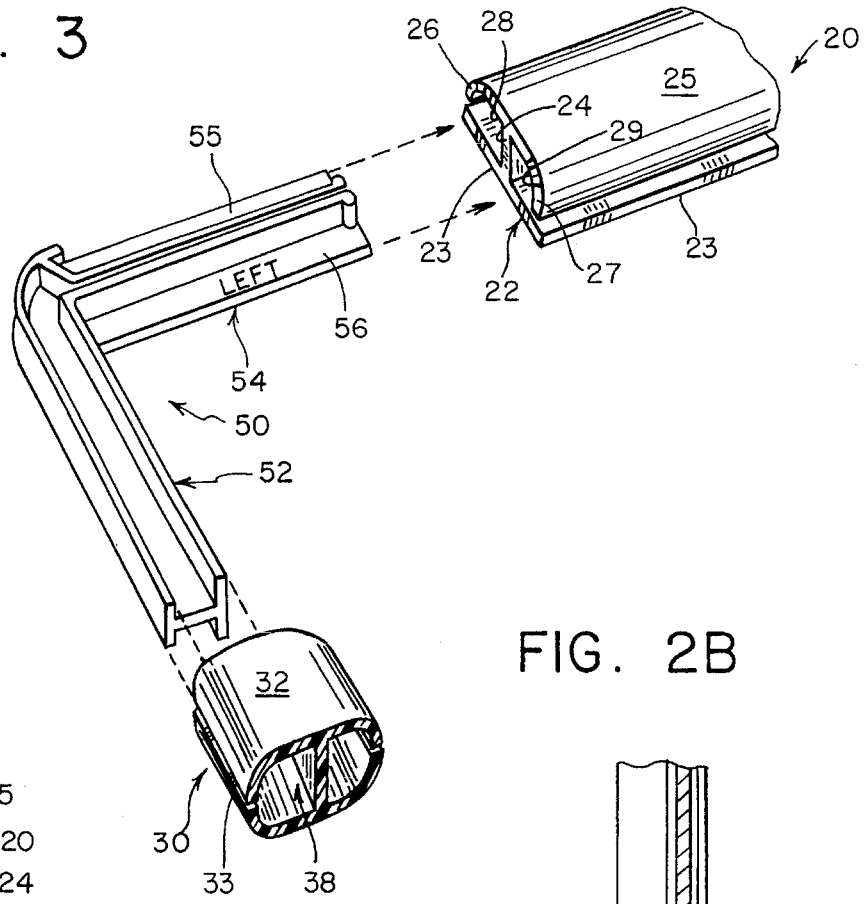
FIG. 3 is an enlarged, fragmentarily-illustrated, exploded perspective view showing the upper left internal angle fitting being inserted into the top frame section and side frame section.
Figure 2A:
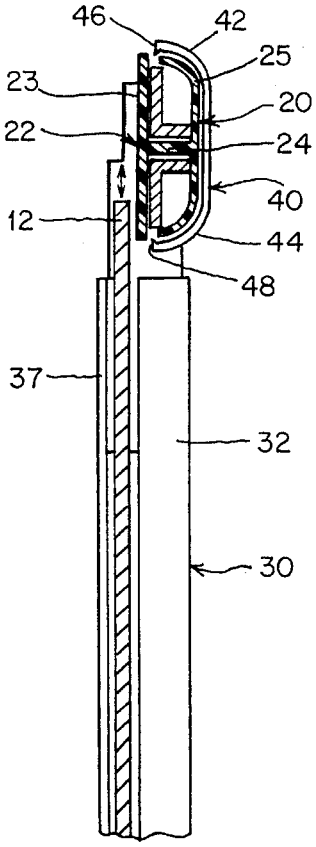
FIG. 2A is an enlarged, fragmentarily-illustrated sectional view along line 2A—2A of FIG. 1.
Figures 4, 5:
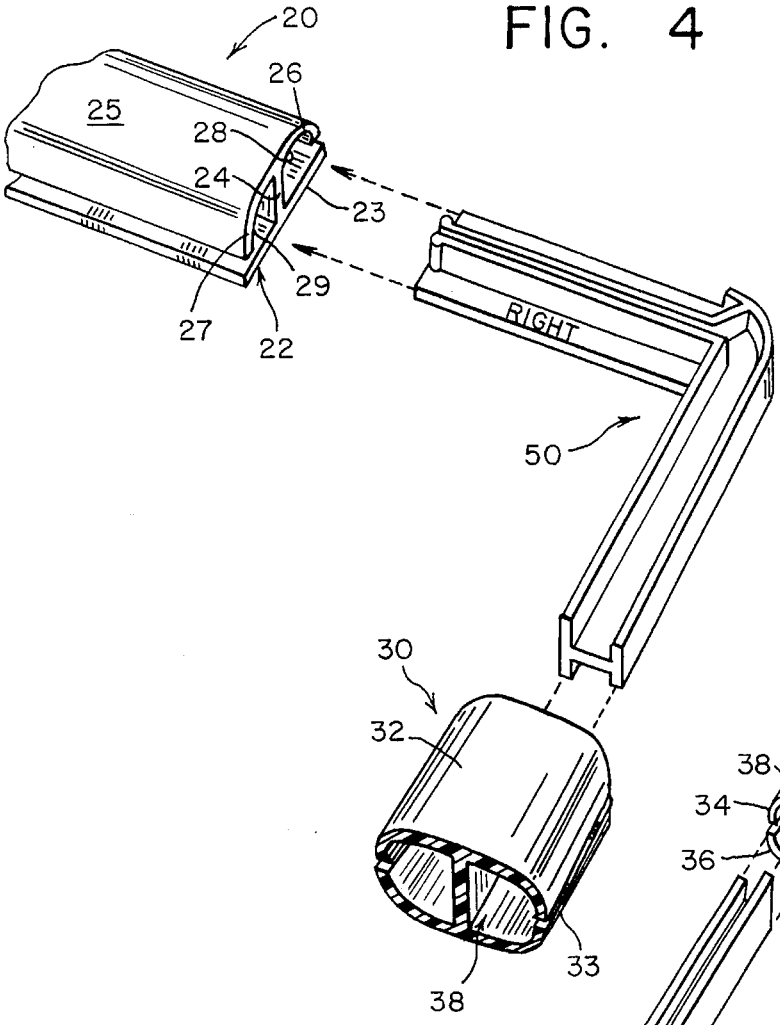
FIG. 4 is an enlarged, fragmentarily-illustrated, exploded perspective view showing the right internal angle fitting being inserted into the opposite end of the top frame section and opposite side frame section.
FIG. 5 is an enlarged, fragmentarily-illustrated, exploded perspective view of the bottom left corner of the frame section, showing the internal angle fitting being inserted into the side and bottom frame sections.

As can be seen best in FIGS. 2A, 3 and 4, the top edge support 20 includes a back plate 22, having a generally inverted T-shaped profile which is composed of a substantially flat base plate 23 and an upstanding leg 24, disposed centrally and normally thereto. A substantially C-shaped dome member 25 is supported on to the top end of leg 24 and is provided with legs 26, 27 which curve downwardly toward the lateral edges of base plate 23, to define slots or gaps between the terminus of legs 26, 27 and the ends of base plate 23, respectively. Legs 26, 27 in cooperation with back plate 22 define a pair of slotted channels 28, 29, the purpose of which will be described in greater detail hereinafter.

Figure 2B:
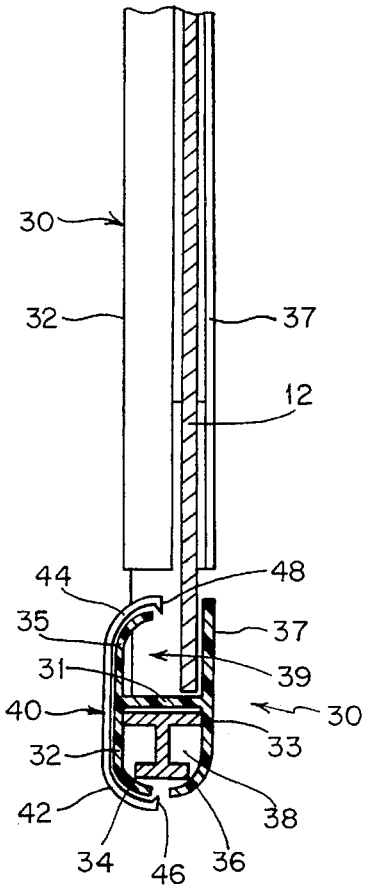
FIG. 2B is an enlarged, fragmentarily-illustrated sectional view along line 2B—2B of FIG. 1.

As best seen in FIGS. 2B and 5 the side and bottom edge supports 30 comprise a flat generally rectilinear base plate 31 having two opposite ends, to which a pair of dome members 32, 33 are interconnected in a generally mirror image fashion. Dome member 32 is C-shaped and has legs 34, 35 and 36, the ends of which extend toward and oppose the corresponding legs 36, 37 of the other dome member so as to define a gap or slot between the ends thereof. Dome member 33 has a curved first leg 36 extending towards but spaced from the first leg 34 of the other dome member 32 and a generally planar second leg 37 spaced from the second leg 35 of the other dome member 32 so as to define a pair of slotted channels, 38, 39 the slotted channel 39 defined between the second legs 35, 37 of the dome members 32, 33 being dimensioned to allow for easy and facile slidable insertion and removal of a side or bottom edge of a poster 12 thereinto and therefrom.

As shown in FIGS. 1, 2A and 2B, elbow-shaped fastening elements 40 are shown having a substantially C-shaped configuration which basically conforms to the shape of dome members 25, 32 of the edge supports 20, 30 but they have an inside diameter that is slightly smaller than the outside diameter of members 25, 32 so that a snap fit results when fastening element 40 is engaged with members 25, 32 because of the increased tension therebetween. The depending legs 42, 44 of fastening element 40, are provided adjacent their ends with inwardly-directed engagement cams or bosses 46, 48, respectively. The configuration and construction of these fastening elements are similar to that of the connecting elements used in an electric cord holder assembly described in my U.S. Pat. No. 4,563,542 (the subject matter of which is incorporated herein by reference thereto). As seen best in FIGS. 2A and 2B, the C-shaped fastening element 40 is pressed over the top of dome members 25, 32 such that the bosses or engagement cams 46,48 extend into gaps between ends 35, 37 and ends 34, 36 in a snap-fit manner, as a result of which the frame sections 20, 30 are joined together in a square or rectangular frame-like arrangement.

As seen best in FIGS. 3 and 4, a pair of left and right, generally L-shaped internal angle fittings 50 are used for internally securing the pair of side edge supports 30 to opposite ends of the top edge support 20. The L-shaped angle fittings 50 each include a first leg 52 configured and dimensioned for frictional receipt within the slotted channel 38 defined by the first legs 34, 36 of the dome members 32, 33 of the second edge supports and a second bifurcated leg 54 having a first arm 55 and a second arm received in opposite channels 28, 29 respectively of the first edge support 20 in a frictional fit manner.

As seen best in FIG. 2A, as a result of the use of the two different configured and dimensioned frame edge supports 20, 30, (the top edge support being approximately one-half the width of the side and bottom edge supports 30) and the design and configuration of the internal angle fittings, 50, 50$^1$, the first edge support 20 is joined to the second edge supports 30 with the base plate 23 of the back plate 22 of the first edge support 20 positioned laterally offset and forwardly of the second leg 37 of the dome member 33 of the second edge support 30. They cooperatively define a display slot whereby a poster or other planar display item 12 may be removably slid into the display frame 10 from above, rearwardly of the first edge support 20 with the lateral edges of the poster 12 being slidably received in the slotted channel defined by and between the second legs 37 of the dome members 33 of the second edge supports 30.

As can be seen in FIGS. 2B, 3 and 4, the first legs 52 of the internal angle fittings 50 have a generally I-beam shaped profile with one leg shorter than the other leg so as to conform generally to the curved channel 38 of the second edge support 30. Preferably, the first leg 52 is dimensioned so as to cause the resilient second edge support 30 to expand slightly during insertion of the leg 52 so as to provide the required frictional engagement to maintain the rigidity of the display frame structure. Similarly, the bifurcated second leg 54 of the internal angle fitting 50 is also suitably dimensioned to cause the resilient top edge support 20 to expand upon insertion thereinto to thereby provide the desired friction fit. The bifurcated or split second leg 54 of the internal edge fitting is preferably provided with two generally L-shaped arms 55, 56.

As can be seen best in FIG. 5, the internal angle fittings 50$^1$ for the lower and bottom corners of the frame sections is further preferably provided with a fluted foot 60 joined to the corner thereof to allow the same to be inserted in a friction fit manner into a similarly configured and dimensioned slotted display stand base 70 (see FIG. 1) by which the display stand may be supported in an upright manner. Both ends of the lower internal fittings 50$^1$ have the I-beam cross sectional configuration so that the same may be frictionally received in the slotted cavities 38 defined by the first legs 34, 36 of the dome members 32, 33 of the second edge supports 30.

Figure 6:
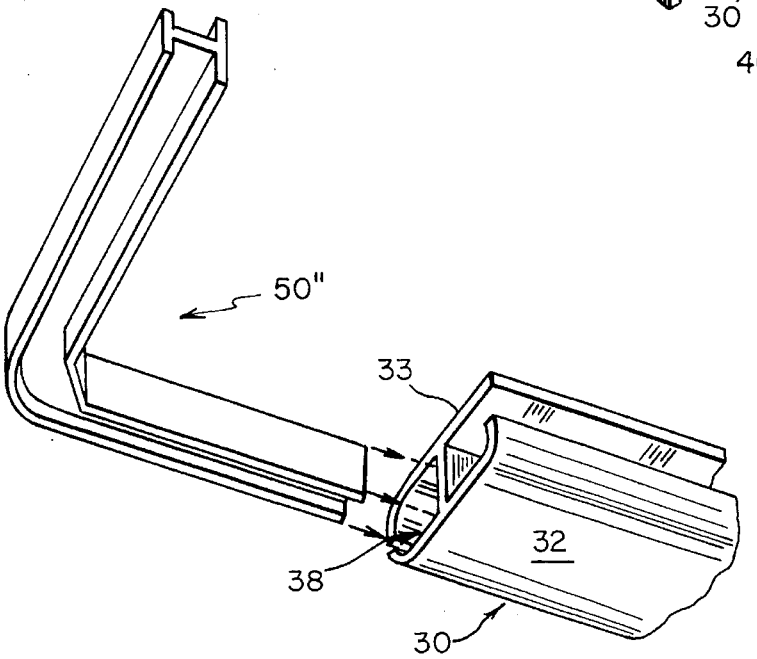
FIG. 6 is an enlarged, fragmentarily-illustrated perspective view of an alternate embodiment of the internal angle fitting used in the bottom portion of the frame, being inserted into the bottom frame edge section.

Alternatively, as shown in FIG. 6, the lower and internal angle fittings 50" could, of course, be provided without the support foot 60. This embodiment could be used if it were intended to hang the frame on a wall or the like.

Figure 7:
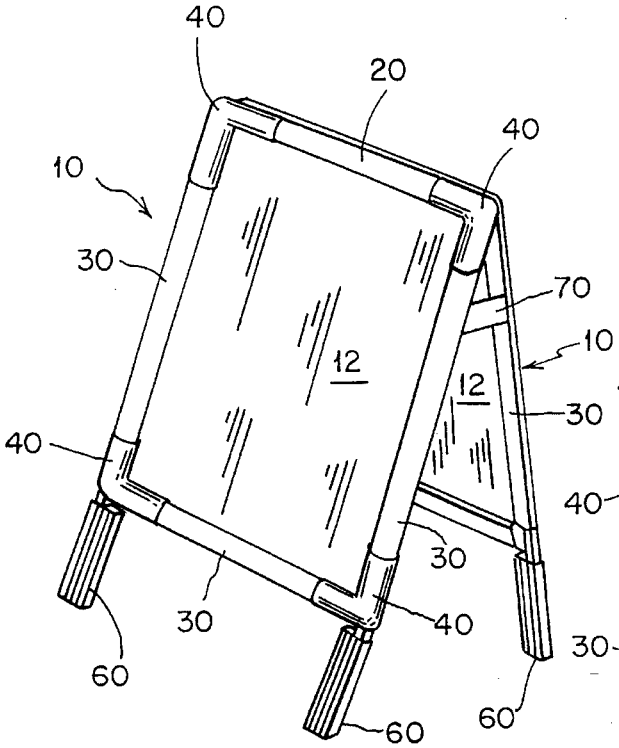
FIG. 7 is a perspective view showing plural display frames being used to form a generally inverted V-shaped display stand.
Figure 8:
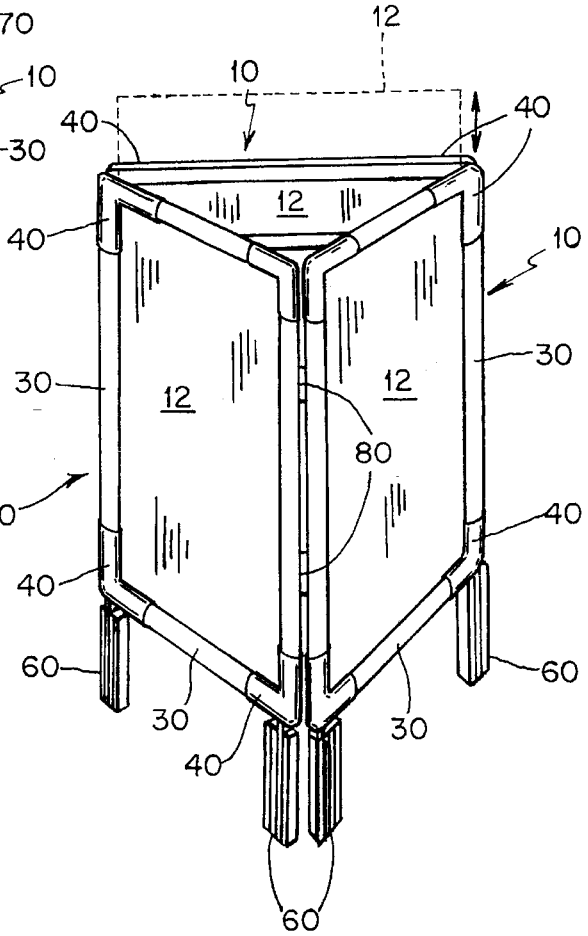
FIG. 8 is a perspective view showing plural display frames of the present invention being used to form a triangular arrangement of three display stands joined together.

FIGS. 7 and 8 illustrate the possibility of combining two or more of the display frames 10 together to form a variety of multiple displays. In particular, two display stands of the present invention are shown being joined together in a V-shaped arrangement in FIG. 7 by the provision of slip on braces 70, the construction and use of which is described in greater detail in my U.S. Pat. No. 5,402,976, the subject matter of which is incorporated hereby by reference thereto.

FIG. 8 discloses the provision of three display stands together in a triangular-shaped arrangement, which arrangements are made possible by the employment of flexible hinges 80 as described in my U.S. Pat. No. 5,398,376, the subject matter of which is incorporated herein by reference thereto. Poster 12 is schematically illustrated in phantom line as it is inserted and/or removed from the rearwardly disposed frame. Although not illustrated, the frames 10 could also be provided with hanging means for hanging the display frame on a wall or the like.

To construct the frame 10, the frame sections composed of the frame edge supports 20, 30 would be cut to the approximate size for the poster or display board 12 to be inserted less about 1 inch, so that the frame sections 20, 30 do not come together. The internal angle fittings 50 would be inserted into the frame sections 20, 30 and the frame would be formed to the exact size required by framing the frame around the actual board 12 to be employed. After the correct dimensions are realized, the snap-on corners 40 would be snapped on over the joined frame sections 20, 30. Since the top frame section 20 of the frame employs essentially a slimmer or thinner frame section, the same acts as a facade to allow for the drop-in insertion of the board or poster material 12 behind it. The frame construction and design essentially form an open drop slot in the frame for the quick and simple insertion and removal of the cardstock material and the like. By adding the internal angle fittings 50 in combination with the snap-on corners there is no need for an exact buttress or exact cut frame length. The internal angle fittings 50 in combination with the existing snap-on corners 40 additionally provide additional hold at all the angle joints of the frame 10 so that a hollow frame is possible. The angle fittings 50" and the edge sections 30 could also be used for all the angle joints and frame sections where a drop-in slot is not needed but additional structural integrity and strength for the frame is required. Many sizes and shapes can be created in this manner to perform a varied array of framing tasks without the need of exact measuring and cutting of the frame sections. No fixturing would be required as well.

Accordingly, while only several embodiments of the present invention have been shown and described, it is to be understood that many changes and modifications may be made thereunto without departing from the spirit and scope of the invention as disclosed herein.

What is claimed is:

1. A display frame for a poster or other picture memorabilia having a top edge and at least two side edges comprising:

a resilient first edge support for the top edge of said poster, said first edge support extending a majority of a length of said top poster edge and including an inverted generally T-shaped back plate, extending said length thereof, having a base leg and an upstanding leg disposed generally normally to said base leg and having a first end interconnected generally centrally of said base leg and a second end, and a generally C-shaped dome member having a center section interconnected with said second end of said upstanding leg of said back plate and two curved legs, each of which extend toward opposite ends of said base leg of said back plate to define, a gap between the ends of said curved legs, and said base leg in cooperation with said base plate and said dome member defining a pair of slotted channels;

a pair of resilient second edge supports for at least the side edges of said poster, each of said second edge supports extending a majority of a length of a respective poster side edge and including a generally rectilinear base plate extending the length thereof having two opposite sides and ends and a pair of dome members having first and second legs, interconnected to opposite ends of said base plate in a generally opposing, mirror-image fashion, one of said dome members being C-shaped with its first and second legs extending toward the first and second legs of the opposing dome member, to define a gap between the ends thereof, the other of said dome members having a curved first leg extending toward but spaced from said first leg of said one dome member and a second leg spaced from said second leg of said one dome member so as to define a pair of slotted channels, the slotted channel defined between the second legs of said dome members being dimensioned to allow for easy and facile slidable insertion and removal of a side edge of a poster thereinto;

a plurality of resilient fastening elements associated with said edge supports for fastening said edge supports together in a frame-like manner, said fastening elements each having first and second legs and being substantially C-shaped to overlay the C-shaped dome members of said first and second edge supports and engage therewith in a snap fit manner; and a pair of generally L-shaped internal angle fittings for securing said pair of said second edge supports to opposite ends of said first edge support, said L-shaped angle fittings each including a first leg configured and dimensioned for frictional receipt within the slotted channel defined by said first legs of said dome members of said second edge supports and a second bifurcated leg having a first arm and a second arm received in opposite channels of said first edge support in a frictional fit manner such that said first edge support is joined to said second edge support with said base leg of said base plate of said first edge support positioned offset and forwardly of said second legs of said second edge supports so as to define therebetween a display slot whereby a poster may be removably slid into said display frame from above, rearwardly of said first edge support with the lateral edges of said poster being slidably received in said slotted channel defined by and between said second legs of said other dome members of said second edge supports.

2. The frame of claim 1, wherein said first edge support is provided for the top edge of the poster and three second edge supports are provided, two for the side edges of the poster and one for the bottom edge.

3. The frame of claim 2, wherein a fastening element is provided at each end of said edge support.

4. The frame of claim 1, wherein the fastening elements comprise elbow-shaped corner fastening elements, to engage with adjacent ends of adjacent edge supports.

5. The frame of claim 1, wherein said edge supports are formed of plastic.

6. A display frame for a poster or other picture memorabilia having a top edge and at least two side edges comprising:

a resilient first edge support for the top edge of said poster, said first edge support extending a majority of a length of said top poster edge;

a pair of resilient second edge supports for at least the side edges of said poster, each of said second edge supports extending a majority of a length of a respective poster side edge;

a plurality of resilient fastening elements for coupling and fastening said edge supports together in a frame-like manner, said fastening elements each having first and second legs and being shaped to overlay said first and second edge supports and engage therewith in a snap fit manner; and a pair of generally L-shaped internal angle fittings for Coupling with and securing said pair of said second edge supports to opposite ends of said first edge support in a frictional fit manner such that said first edge support is joined to said second edge supports with a rear wall of said first edge support positioned offset and forwardly of a rear wall of said second edge supports so as to define therebetween a display slot whereby a poster may be removably slid into said display frame from above, rearwardly of said first edge support with the lateral edges of said poster being slidably received in a slotted channel defined by and between said second edge supports.

* * * * *